United States Patent [19]

Van Gunten et al.

[11] 3,946,957

[45] Mar. 30, 1976

[54] TRAVERSING MECHANISM

[75] Inventors: Paul Richard Van Gunten, Toledo; John Gilbert Mohr, Maumee, both of Ohio

[73] Assignee: Johns-Manville Corporation, Denver, Colo.

[22] Filed: Sept. 26, 1973

[21] Appl. No.: 401,015

[52] U.S. Cl. ..... 242/43 R; 242/18 G; 242/43.2

[51] Int. Cl.[2] ..... B65H 54/28

[58] Field of Search ..... 242/43, 43.2, 18 G

[56] References Cited

UNITED STATES PATENTS

| | | | |
|---|---|---|---|
| 1,990,620 | 2/1935 | Schweiter | 242/43.2 |
| 3,399,841 | 9/1968 | Genson | 242/43 |

*Primary Examiner*—Stanley N. Gilreath
*Attorney, Agent, or Firm*—Robert M. Krone; John H. Miller

[57] ABSTRACT

An apparatus for winding continuous strands of material about rotating cores to form strand packages is provided with primary traversing mechanisms which impart a primary traversing motion to the strands as they are being wound on the packages whereby the strands progress and regress to define a series of bights. A secondary traversing mechanism is provided to impart a secondary traversing motion to the strands relative to the packages to advance the series of bights back and forth across the peripheral face of the packages. The primary traversing mechanisms each comprise a plurality of elongate straight elements which are supported in spaced-apart parallel relationship to define a cylindrical pattern. Each primary traversing mechanism is mounted on its axis of rotation so that the elongate elements extend at an oblique angle relative to the axis of rotation of the traversing mechanism.

2 Claims, 4 Drawing Figures

TRAVERSING MECHANISM

BACKGROUND OF THE INVENTION

The present invention is related to a traversing mechanism and particularly to an improved traversing mechanism which effects a primary traversing movement of a plurality of strands while maintaining the strands separated, if desired and without destroying the integrity of the strands.

While other applications for the traversing mechanism of the present invention may be found, the traversing mechanism of the present invention is primarily intended for use in the manufacture of continuous glass strands. In this instance, a plurality of continuous glass strands are drawn from a bushing and wound onto packages. The packages of strands are then moved to a chopping operation where the strands are unwound from the package and passed through a chopper which chops the strands into short fiber bundles of a desired length. These fiber bundles are utilized in the reinforcement of plastics, to produce chopped strand mat and for other similar purposes.

For this type of process it is important that the individual strands maintain their integrity during the chopping operation and that the bundles of fibers formed during the chopping operation maintain their integrity. The strands or the short fiber bundles should not break up into individual filaments or fibers. In addition the traversing mechanism should be capable of maintaining the separate strands being wound onto a package spaced relative to each other so that when the strands are chopped they come off the package at the same time but as individual strands rather than as a single strand.

Traversing devices such as the traversing device illustrated in U.S. Pat. No. 3,399,841 issued Sept. 3, 1968 to S. R. Gensen have been developed for the formation of packages with one or more strands. However, due to the continuous contact of the strands with the cylindrical surface of the traversing device of Gensen, the integrity of the strands (the ability of the strand filaments to remain bonded together) is greatly reduced. Consequently, when the strands are chopped, the fiber bundles become fuzzed at the ends or entirely disintegrate into the component filaments thereby making them unsuitable for reinforcement or chopped strand mat. It is thought that the reduction in strand integrity caused by this particular traversing mechanism is caused, at least in part, by forces which are continuously exerted on the strands as they pass over the cylindrical surface of the traverse. These forces tend to separate the filaments of the strands. In addition, binder is removed from the strands as the strands pass over the cylindrical surface of the traverse.

It is an object of the present invention to provide a traversing mechanism which can maintain the strands in spaced-apart relation as they are being traversed and which can maintain the integrity of the strands.

This is accomplished by providing a traversing mechanism which only has point contact with the strands at spaced-apart intervals along the strands. More specifically, the traversing mechanism comprises a plurality of elongate straight elements which are supported in spaced-apart parallel relationship to define a cylindrical pattern. The elements are mounted with the axis of the elongated elements at an oblique angle with respect to the axis of rotation of the traversing mechanism and as the traversing mechanism is rotated the elongate elements make point contact with the strands to move the strands back and forth in a rapid, small amplitude traversing motion.

DETAILED DESCRIPTION OF THE PREFERRED EMBODIMENT

Figure 1:
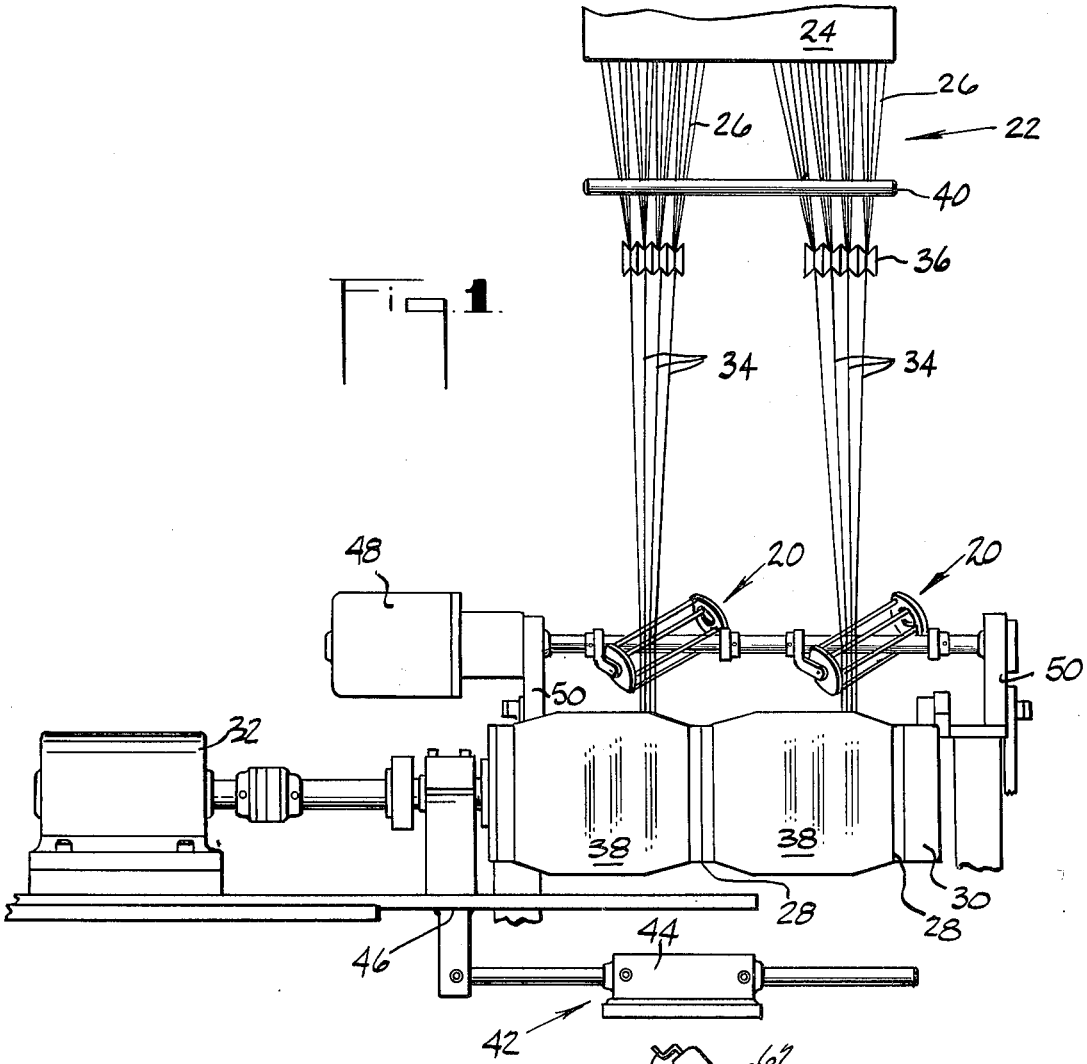
FIG. 1 is a front elevation of an apparatus for forming a plurality of multi-filament glass strands and for winding the plurality of strands into packages.
Figure 2:
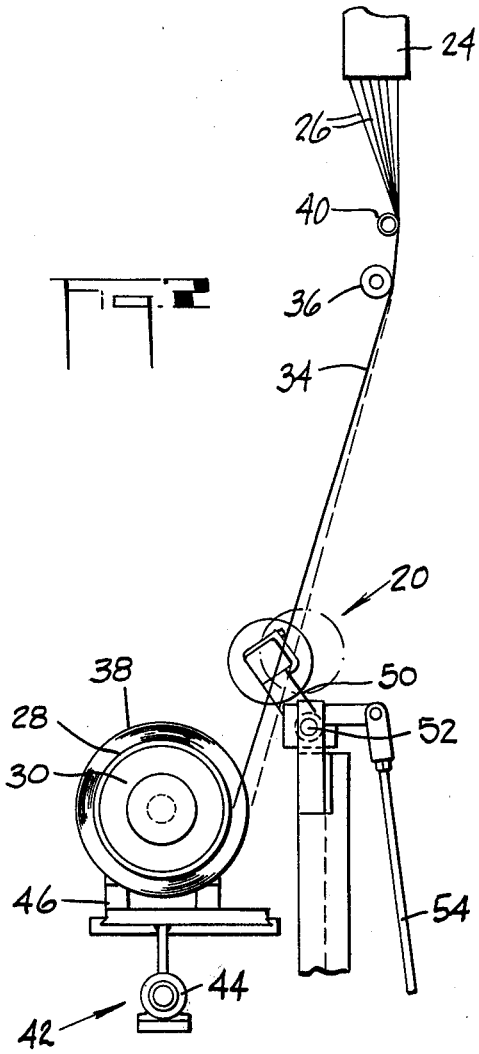
FIG. 2 is an end elevation of the apparatus of FIG. 1 as viewed from the right of FIG. 1.

FIGS. 1 and 2 illustrate a pair of traversing mechanisms 20 of the present invention which are utilized in an apparatus 22 for forming a plurality of multi-filament continuous glass strands. The apparatus 22 includes a glass melting receptacle or bushing 24 from which a plurality of filaments 26, (e.g., 1600 filaments) are drawn by rotating cores 28 that are mounted on a rotating mandrel 30 which is driven by a motor 32. The filaments 26 are gathered into a plurality of strands 34 (e.g., eight two-hundred filament strands) by a plurality of converging rollers 36. The strands are then wound onto the rotating cores 28 to form packages 38. Binders and the like are applied to the filaments 26 as they are drawn together to form the strands 34 by a binder applicator 40.

There are two traversing assemblies. The traversing mechanisms 20 are the primary traversing assembly and the traversing assembly 42 is the secondary traversing assembly. The secondary traversing assembly 42 includes a double acting hydraulic piston and cylinder assembly 44 which slowly reciprocates the packages of strand 38 back and forth relative to the traversing mechanisms 20 by moving the mandrel support 46. The packages 38 are each carried on the mandrel 30 so that the centers of the packages lie in vertical planes which are centered relative to the series of strands 34 being wound onto the particular package when the package is mid-way along its traversing path. The length of the reciprocating movement of the secondary traverse is regulated to form the packages 38 to the desired width.

The traversing mechanisms 20 of the primary traversing assembly rapidly effect a series of progressive and regressive bights of the strands to deter the formation of a parallel lay of adjacent windings. Thus, the primary traverse effects a series of rapidly formed progressive and regressive bights of small amplitude while the secondary traverse slowly effects a progression of these bights across the package being formed to helically wrap the series of bights back and forth across the entire width of the package. While the secondary traversing action is generally effected by moving the the mandrel 30 relative to the traversing mechanisms 20 which are held stationary, it will be understood that the secondary traversing action can be effected by holding the mandrel 30 stationary and moving the primary traverses 20 in an axial direction relative to the mandrel 30.

As best shown in FIG. 2, the traversing mechanisms 20 are rotated by a motor 48 and pivotally mounted on mounting brackets 50. The brackets 50 are pivoted about an axis 52 by a mechanism 54 such as the mechanism illustrated in U.S. Pat. No. 3,695,523 issued Oct. 3, 1972 to Samuel R. Gensen et al. The primary traversing mechanisms 20 are moved away from the winding axis of the packages 38 as the packages build up in diameter to maintain the traversing mechanisms a desired distance away from the peripheral surfaces of the packages being formed. While FIGS. 1 and 2 illustrate an assembly wherein the primary traversing mechanisms 20 are moved away from the packages 38 means can also provide it to move the packages away from the traversing mechanisms.

Figure 3:
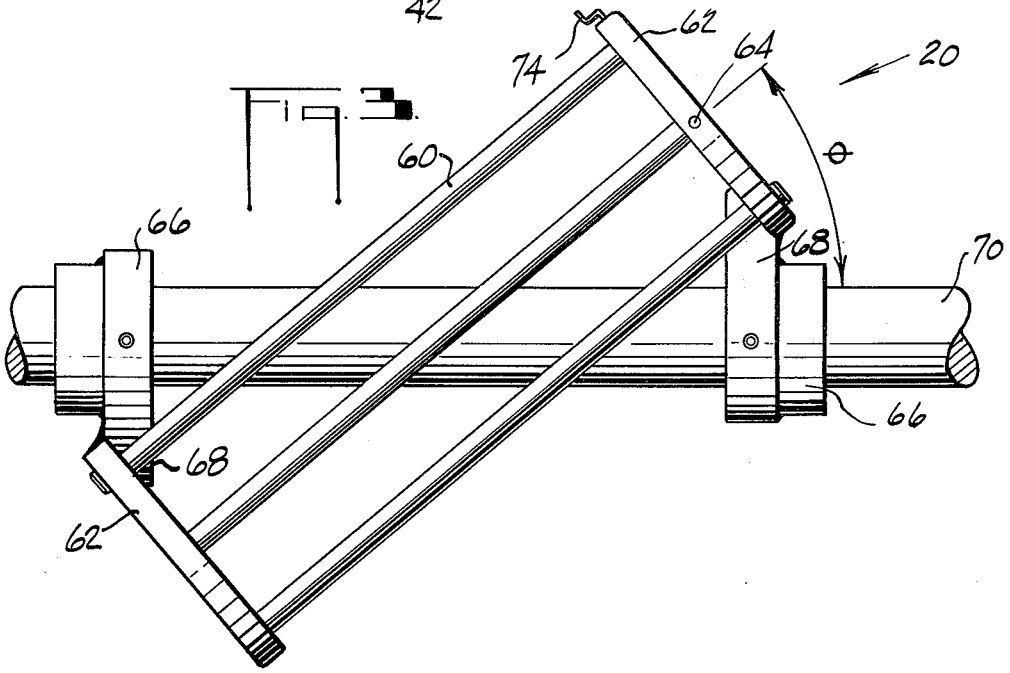
FIG. 3 is an enlarged view of a traversing mechanism of FIG. 1 taken parallel to the axis of rotation of the traversing device.
Figure 4:
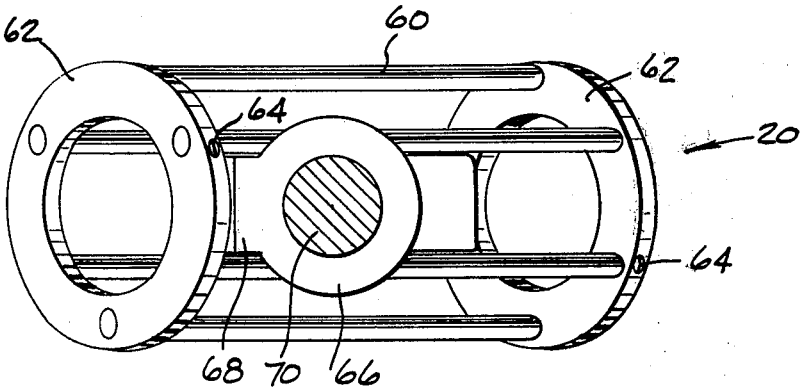
FIG. 4 is and end view of the traversing mechanism of FIG. 1 taken perpendicular to the axis of rotation of the traversing mechanism with the traversing mechanism rotated 90° relative to its position in FIG. 3.

As best shown in FIGS. 3 and 4, the traversing mechanisms 20 of the present invention each include a plurality of elongated cylindrical rods or wires 60 (e.g., 6 wires) which are mounted at each end in rings 62. The rods 60 extend parallel with respect to each other and are spaced-apart about the rings 62 to define a cylindrical pattern. The ends of the rods 60 are received within apertures of the annular rings 62 with the rods either passing part way or all the way through the rings. The rods are secured to the rings by set screws 64, similar fastening devices or by brazing. While the dimensions of the traversing mechanisms 20 can vary a typical traversing device employs rods about 6-½ inches long with the rods being arranged in a generally cylindrical pattern having a diameter of about 2-½ inches. The traversing mechanisms 20 are made of S.A.E. 72 brass or similar metallic materials.

Each of the rings is secured to a collar 66 by an extension 68 of the collar which extends radially out from the collar in a direction perpendicular to the axis of rotation 70 of the traversing mechanism. The support rings 62 are both brazed and bolted or otherwise secured to the extensions 68 at an oblique angle relative to the axis of rotation of the traversing mechanism. While the oblique angle can vary from 30° to 45°, the preferred embodiment employs an angle theta of about 40°.

Each traversing mechanism can be provided with a starting pin 74 which is mounted in one of the rings 62. The pin 74 extends inward toward the center of the traversing mechanism in a direction parallel to the rods 60 and then radially outward.

In operation the series of strands 34 for each package 38 are started at the ends of cores 28 with the strands out of contact with the traversing mechanisms 20. Once the strands 34 are being pulled from the bushing 24 and wrapped on the cores at the proper rate the traversing of the strands to form the packages is started. The strands can be placed in contact with the traversing mechanism 20 either manually or through the starting pins 74. Once the traversing of the strands is started the strands are rapidly moved back and forth by the traversing mechanisms 20 to form a series of bights of small amplitude and the series of bights are moved back and forth across the surfaces of the packages 38 being formed by the secondary traversing assembly 42 until the packages reach the desired diameter.

What is claimed is:

1. An apparatus for winding continuous strands of flexible material about a core to form a package which apparatus includes a source of said strands, means for rotating said core about a first axis, a traversing mechanism rotatable about a second axis parallel to said first axis and adjacent to a peripheral surface of said package for imparting primary traversing motions to said strands as they are being wound on said package whereby said strands progress and regress to define a series of bights, and means for imparting a secondary traversing motion to the strands relative to the package to advance the series of bights across the peripheral surface of the package, the improvement comprising: said traversing mechanism comprising at least six elongate straight rods having rounded surfaces for contacting said strands, support means supporting said elongate rods in spaced-apart parallel relationship to define a cylindrical pattern, mounting means for mounting said mechanism so that the axes of said elongate rods extend at an oblique angle of about 30° to 45° relative to said second axis about which said traversing mechanism is rotated.

2. The improvement as defined in claim 1 wherein: the angle of said elongate elements relative to said second axis is about 40°.

* * * * *